United States Patent [19]

Mine et al.

[11] Patent Number: 5,011,369

[45] Date of Patent: Apr. 30, 1991

[54] REGENERATIVE PUMP

[75] Inventors: Koichi Mine; Sigeru Suzuki, both of Obu, Japan

[73] Assignee: Aisan Kogyo Kabushiki Kaisha, Obu, Japan

[21] Appl. No.: 287,324

[22] Filed: Dec. 21, 1988

[30] Foreign Application Priority Data

| | | | |
|---|---|---|---|
| Dec. 28, 1987 | [JP] | Japan | 62-335238 |
| Dec. 28, 1987 | [JP] | Japan | 62-335239 |
| Dec. 28, 1987 | [JP] | Japan | 62-335240 |

[51] Int. Cl.[5] ..... F04D 17/06

[52] U.S. Cl. ..... 415/55.1; 415/55.6

[58] Field of Search ..... 415/55.1, 55.5, 55.4, 415/55.2, 55.3, 55.6, 55.7

[56] References Cited

U.S. PATENT DOCUMENTS

| | | | |
|---|---|---|---|
| 1,665,687 | 4/1928 | Derrick | 415/55.4 X |
| 2,282,569 | 5/1942 | Fabig | 415/55.5 |
| 3,359,908 | 12/1967 | Toma | 415/55.5 X |
| 3,392,675 | 7/1968 | Taylor | 415/55.4 |
| 3,788,766 | 1/1974 | Engels | 415/55.5 |
| 4,508,492 | 4/1985 | Kusakawa et al. | 415/55.5 X |
| 4,591,311 | 5/1986 | Matsuda et al. | 415/55.5 |

FOREIGN PATENT DOCUMENTS

| | | | |
|---|---|---|---|
| 138297 | 7/1985 | Japan | 415/55.1 |
| 2134598 | 8/1984 | United Kingdom | 415/55.6 |

*Primary Examiner*—John T. Kwon

*Attorney, Agent, or Firm*—Dennison, Meserole, Pollack & Scheiner

[57] ABSTRACT

Three embodiments of a regenerative pump: the first embodiment is composed of a body and casing separated by an intermediate ring-like spacer having a central annular area the wall of which forms the outer peripheral boundary of a radially defined chamber through which move the vanes of an impeller rotatably mounted in the center of the spacer. Inlet and outlet ports are placed in fluid communication with each other by virtue of the chamber as the impeller rotates. Concentric and overlapping grooves formed on the upper surface of the body and the lower surface of the case have a particular geometry the arrangement of which leads to a substantial reduction in noise contributed by fluid flowing in the region of the outlet port. In a second embodiment of the invention, the downstream portion of each of the grooves extends along a gentle curved line which terminates substantially without deflection in the outlet hole. The third embodiment comprises a multi-stage pump in which the intermediate spacer is formed with an inclined surface adopted to form a smooth fluid connection with the vanes of the second or upper impeller. At the same time, at the position corresponding to the location of the communication hole of the second spacer, is formed with an inclined surface which is substantially parallel to inclined surface formed on the intermediate spacer.

16 Claims, 7 Drawing Sheets

FIG.9
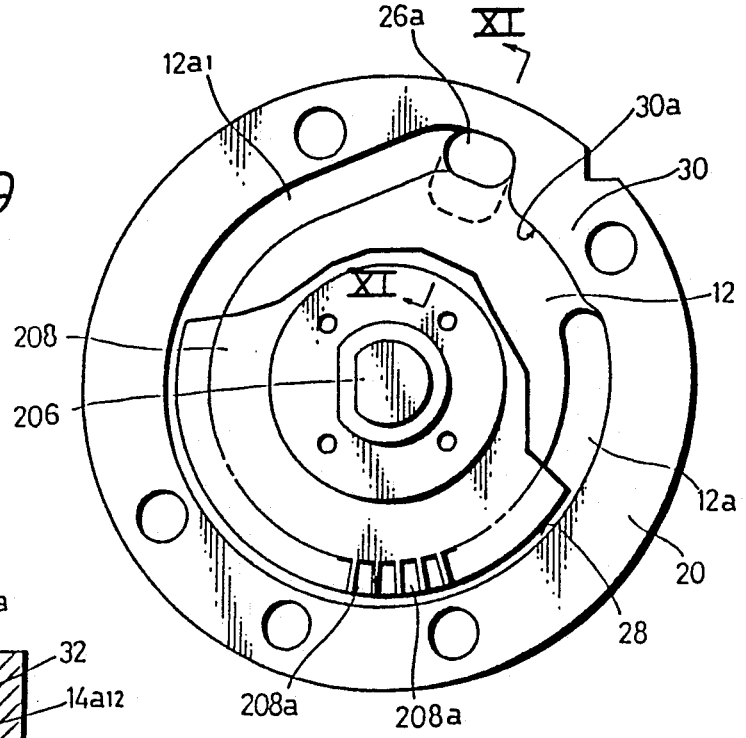
FIG.11
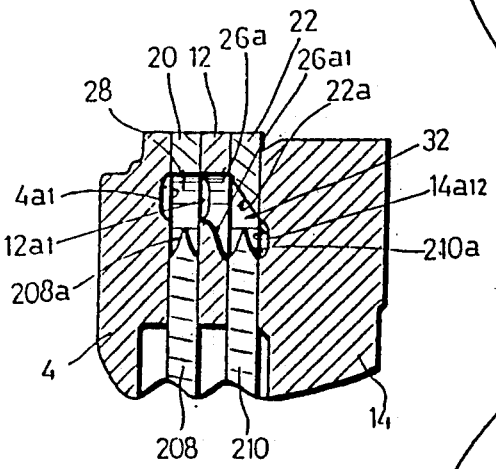
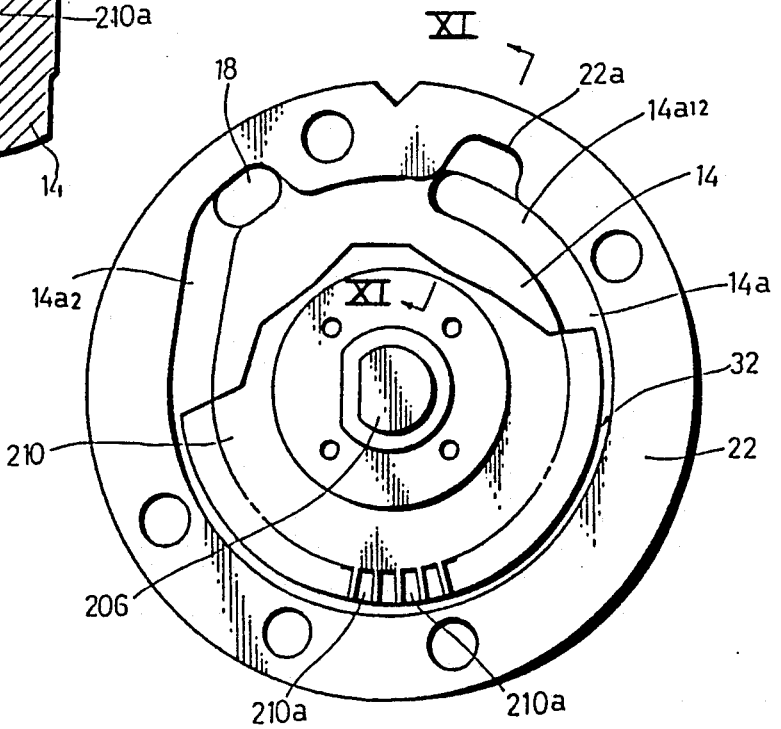
FIG.10

REGENERATIVE PUMP

BACKGROUND OF THE INVENTION

The present invention relates to a regenerative pump and more particularly to a regenerative pump which reduces pump noise.

A conventional regenerative pump will now be described with reference to FIGS. 12 to 16. FIG. 12 shows a motor-driven pump unit to suck up fuel for automobiles and the like from a fuel tank, in which a regenerative pump 200 is provided in a lower part of the pump unit. The regenerative pump 200 includes a body 204 constituting a pump wall of the lower side of the regenerative pump 200 with a fuel inlet hole 202 (see FIG. 14), a first impeller 208 and a second impeller 210 both fixed to an armature shaft 206 of a motor disposed substantially in the center of the pump unit, an annular intermediate plate 212 interposed between the first impeller 208 and the second impeller 210, and a cover 214 constituting a partition wall between the motor and the regenerative pump 200. A central hole 216 for inserting the armature shaft 206 and an outlet hole 218 shown in FIG. 16 leading to the motor are formed on the cover 214. Reference numerals 220 and 222 designate first and second annular spacers disposed concentrically surrounding the first impeller 208 and the second impeller 210 and constituting a pump wall in the radial direction. The cover 214 is caulked to the end portion of a motor casing 221, to which the second spacer 222, the intermediate plate 212, the first spacer 220 and the body 204 are piled in this order and secured by screws 214.

On the body 204, the intermediate plate 212 and the cover 214, there are provided grooves 204*a*, 212*a* and 212*b* on both sides of the intermediate plate 212 facing the first impeller 208 and the second impeller 210 as well as 214*a* at the positions corresponding to vane channels 208*a* and 210*a* formed at the outer peripheral portion of the first impeller 208 and the second impeller 210. These grooves 206*a*, 212*a*, 212*b* and 214*a* extend within the predetermined respective angles. The grooves 204*a* and 212*a* facing the outer periphery of the first impeller 208 and an inner circumferential surface of the first spacer 220 constitute a first flow passage 228 starting from the inlet hole 202 leading to a communication hole 226 shown in FIG. 15 and 16 through the intermediate plate 212. As shown in FIG. 15, at the inner circumferential surface of the first spacer 220, a partition wall 230 is formed projecting inwardly in the radial direction within the range between the inlet hole 202 and the communication hole 226 and having an arcuate surface 230*a* of substantially the same diameter as the first impeller 208 so as to prevent flow of the fuel therebetween.

Similarly, the grooves 214*a* and 212*b* facing the outer periphery of the second impeller 210 and an inner circumferential surface of the second spacer 222 constitute a second flow passage 232 starting from the communication hole 226 leading to the outlet hole 218. As shown in FIG. 16, at the inner circumferential surface of the second spacer 222, a partition wall 234 is formed projecting inwardly in the radial direction within the range between the communication hole 226 and the outlet hole 218 and having an arcuate surface 234*a* of substantially the same diameter as the second impeller 210 so as to prevent the flow of the fuel therebetween. Reference numerals 236 in FIG. 15 and 238 in FIG. 16 show insertion holes formed through the first spacer 220 and the second spacer 222 for inserting screws 224 thereinto.

This kind of motor-driven fuel pump is arranged to conduct electricity to the motor through a connecting terminal 240 and rotate the armature shaft 206, thereby rotating the first impeller 208 and the second impeller 210 and sucking up the fuel in the fuel tank (not shown) from the inlet hole 202 and pumping the same from the first flow passage 228 through the communication hole 226 to the second flow passage 232 and further to within the motor casing 221 through the outlet hole 218 and then to the outside of the pump unit through an outlet port 242 after passing around the armature.

In the regenerative pump 200 described above, when the fuel flows from the first flow passage 228 to the communication hole 226 and from the second flow passage 232 to the outlet hole 218, the fuel strikes against one end of the corresponding partition walls 230 and 234 in the state of a spiral vortex (the spiral vortex like this as shown by an arrow in FIG. 13 flows outwardly in the radial direction along the vane channels 208*a*, and strikes against the wall in the radial direction of the flow passage 228, and flows inwardly in the radial direction along the grooves 204*a* and 212*a* and then flows outwardly in the radial direction again along the vane channels 208*a*, which is a circulated flow.), causing a high-frequency sound with a frequency of the number of vanes of the first impeller 208 and the second impeller 210 multiplied by the number of rotation of the impellers per second, resulting in a noise (so called impeller noise).

Japanese Patent Publication Nos. 39-9738 and 39-13692, Japanese Utility Model Publication Nos. 39-143, 46-8745 and 47-21203 and Japanese Utility Model Laid-Open Publication No. 52-126303 propose structures to change the configuration of the flow passage at the outlet side in various ways so as to reduce the noise. Japanese Patent Publication No. 39-13692, for example, discloses the structure of gradually decreasing the cross-sectional area of the flow passage.

Japanese Patent Laid-Open Publication No. 58-101263 discloses the structure providing in the flow passage at the region of the outlet side with a straight portion substantially extending in the tangent direction from an impeller. The straight portion extends to the outside of the regenerative pump and is connected to an outlet pipe rising up in the axial direction of the motor body and disposed on the outside of the motor housing. This structure may reduce an impeller noise, however, the outlet pipe is provided outside the pump unit. Therefore, the size of the pump becomes large and the motor is not cooled by the flow of fluid. Moreover, it is difficult to adopt this structure for multi-stage regenerative pump.

SUMMARY OF THE INVENTION

A primary object of the present invention is to provide a regenerative pump excellent in the effect of reducing the pump noise.

Another object of the present invention is to provide a regenerative pump of a simple structure without a large-sized construction and enabling the noise to be reduced.

A further object of the present invention is to provide a multi-stage regenerative pump of a simple structure without a large-sized construction and obtaining a reducing effect of the noise.

SUMMARY

According to a first aspect of the present invention, there is provided in a regerative pump including a body forming a lower wall surface of a pump chamber; a case forming an upper wall surface of said pump chamber; a ring-like spacer interposed between said body and said cover and forming a radially outside peripheral wall surface of said pump chamber; an impeller provided in said pump chamber defined among said body, said cover and said spacer so as to be rotated in one direction, said impeller having outer peripheral vane channels; said ring-like spacer comprising a ring portion having a circular outer circumferential surface and forming said radially outside peripheral wall surface of said pump chamber, and a partition wall projecting inwardly from a part of an inner peripheral surface of said ring portion and extending in a predetermined angular range along the rotational direction of said impeller so as to form a leading end on a side of the rotational direction of said impeller, a trailing end on a counter side of the rotational direction of said impeller, and an inner peripheral surface opposed to an outer periphery of said impeller with a very small clearance defined therebetween; a fluid inlet hole formed through said body so as to be communicated with said pump chamber at a position corresponding to said leading end of said partition wall and said vane channels of said impeller; a fluid outlet hole formed through said cover so as to be communicated with said pump chamber at a position corresponding to said trailing end of said partition wall; and a pair of grooves formed on an upper surface of said body and a lower surface of said case and extending from said fluid inlet hole to said fluid outlet hole along the inner peripheral surface of said partition wall; the improvement wherein a portion of said inner peripheral surface of said ring portion in the vicinity of said trailing end of said partition wall is formed with a recess gradually deepened radially outwardly within a predetermined angular range until said trailing end; said grooves are gradually diverged radially outwardly at a downstream portion thereof along a bottom of said recess; and said fluid outlet hole is formed at a position corresponding to a downstream end of said grooves.

As mentioned above, the downstream portion of each groove is gradually diverged radially outwardly from the outer periphery of the impeller as reaching the trailing end of the partition wall of the spacer. Accordingly, the magnitude of the vortex generated in the grooves at the downstream portion is gradually reduced as reaching the trailing end of the partition wall. In general, if a violent vortex of fluid collides with the trailing end of the partition wall, a large kinetic energy of the fluid causes generation of a large pump noise. However, according to the present invention, since the kinetic energy of the fluid is reduced upon collision with the trailing end of the partition wall, the pump noise can be reduced.

Furthermore, according to the construction of the pump of the present invention, such a noise reduction structure is formed within an outer diameter of the ring-like spacer, thereby eliminating the need for enlarging the radial size of the pump. Thus, the present invention provides a regenerative pump which is compact and can attain a low pump noise.

In the above-mentioned construction, the trailing end of the partition wall is preferably rounded, so that the pump noise may be more reduced.

According to a second aspect of the present invention, there is provided in a multi-stage regenerative pump including a body forming a lower surface of a first pump chamber; a first ring-like spacer fixed on an upper surface of said body and forming a radially outside peripheral wall surface of said first pump chamber; an intermediate plate fixed on an upper surface of said first spacer and forming an upper wall surface of said first pump chamber and a lower wall surface of a second pump chamber; a first impeller provided in said first pump chamber defined among said body, said intermediate plate and said first spacer so as to be rotated in one direction, said first impeller having outer peripheral vane channels; a second ring-like spacer fixed on an upper surface of said intermediate plate and forming a radially outside peripheral wall surface of said second pump chamber; a case forming an upper wall surface of said second pump chamber; a second impeller provided in said second pump chamber defined among said intermediate plate, said case and said second spacer so as to be rotated in said one direction, said second impeller having outer peripheral vane channels; each of said first and second spacers comprising a ring portion having a circular outer circumferential surface and forming said radially outside peripheral wall surface of each of said first and second pump chambers, and a partition wall projecting inwardly from a part of an inner peripheral surface of said ring portion and extending in a predetermined angular range along the rotational direction of each of said first and second impellers so as to form a leading end on a side of the rotational direction of each said impeller, a trailing end on a counter side of the rotational direction of each said impeller, and an inner peripheral surface opposed to an outer periphery of each said impeller with a very small clearance defined therebetween; a fluid inlet hole formed through said body so as to be communicated with said first pump chamber at a position corresponding to said leading end of said partition wall of said first spacer and said vane channels of said first impeller; a communication hole formed through said intermediate plate to communicate said first pump chamber with said second pump chamber at a position corresponding to said trailing end of said partition wall of said first spacer and said leading end of said partition wall of said second spacer; a fluid outlet hole formed through said cover so as to be communicated with said second pump chamber at a position corresponding to said trailing end of said partition wall of said second spacer; a first pair of grooves formed on an upper surface of said body and a lower surface of said intermediate plate and extending from said fluid inlet hole to said communication hole along the inner peripheral surface of said ring portion of said first spacer except the inner peripheral surface of said partition wall of said first spacer; and a second pair of grooves formed on an upper surface of said intermediate plate and a lower surface of said case and extending from said communication hole to said fluid inlet hole long the inner peripheral surface of said ring portion of said second spacer except the inner peripheral surface of said partition wall of said second spacer; the improvement wherein a portion of said inner peripheral surface of said ring portion of each of said first and second spacers in the vicinity of said trailing end of said partition wall of each said spacer is formed with a recess gradually deepened radially outwardly within a predetermined angular range until said trailing end of said partition wall of each said spacer; said grooves are gradually diverged radially outwardly at a downstream portion thereof along a bottom of said recess; a lower opening of said communication hole is formed at a position corresponding to a downstream end of said first pair of said grooves; and said fluid outlet hole is formed at a position corresponding to a downstream end of said second pair of said grooves.

As mentioned above, the downstream portion of each pair of the grooves is gradually diverged radially outwardly from the outer periphery of each impeller as reaching the trailing end of the partition wall of each spacer. Accordingly, the magnitude of the vortex generated in the grooves at the downstream portion in each pump stage is gradually reduced as reaching the trailing end of the partition wall. Therefore, upon collision of the fluid with the trailing end, the pump noise can be greatly reduced.

Furthermore, such a noise reduction structure is formed within an outer diameter of each ring-like spacer, thereby eliminating the need of enlarging the radial size of the pump.

According to one preferred embodiment of the present invention, a lower opening of the communication hole faces the downstream end of the first pair of the grooves outside the outer periphery of the first impeller, and an upper opening of the communication hole faces the vane channels of the second impeller. With this construction, in addition to reliable noise reduction effect, it is possible to reduce a length of the effective raising pressure flow passage.

The invention will be more fully understood from the following detailed description and appended claims when taken with the drawings.

BRIEF DESCRIPTION OF THE DRAWINGS

FIGS. 9 and 10 are sectional views corresponding to FIGS. 1 and 2, respectively, according to a third preferred embodiment;

FIG. 11 is a sectional view taken along the line XI—XI in FIGS. 9 and 10;

DETAILED DESCRIPTION OF THE PREFERRED EMBODIMENTS

A first preferred embodiment of the present invention will be described with reference to FIGS. 1 to 2.

Figure 1:
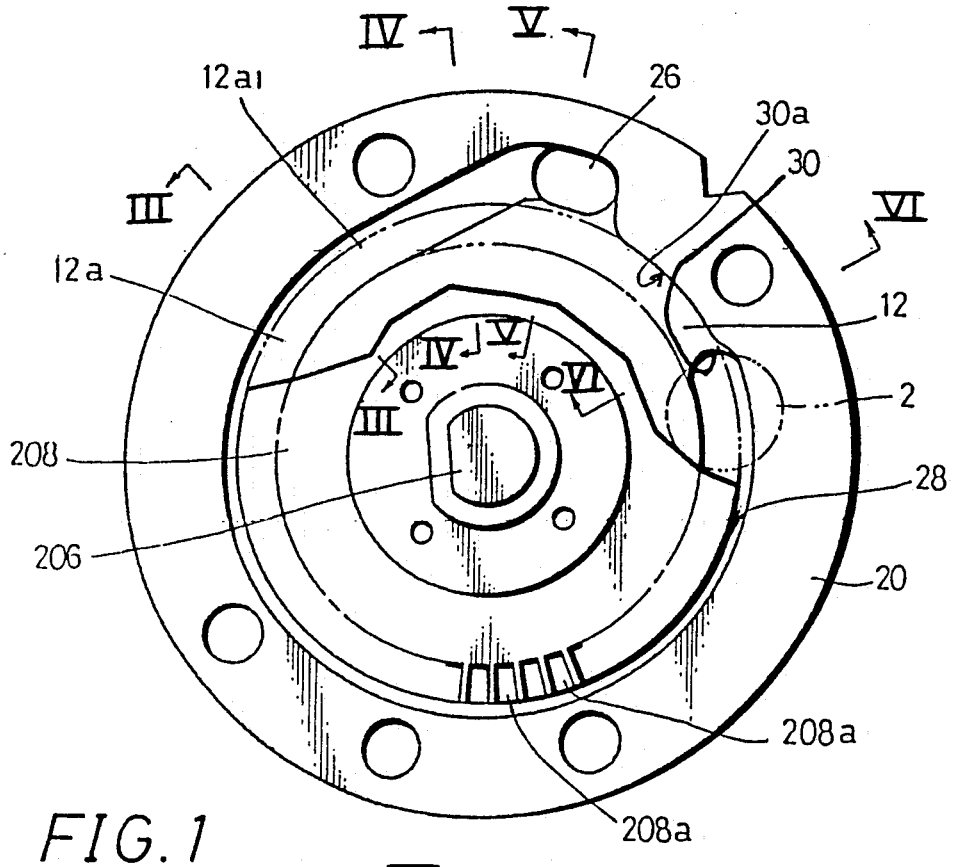
FIGS. 1 and 2 are views corresponding to the sections taken along the lines XV—XV and XVI—XVI in FIG. 12, respectively, according to a first preferred embodiment.
Figure 2:
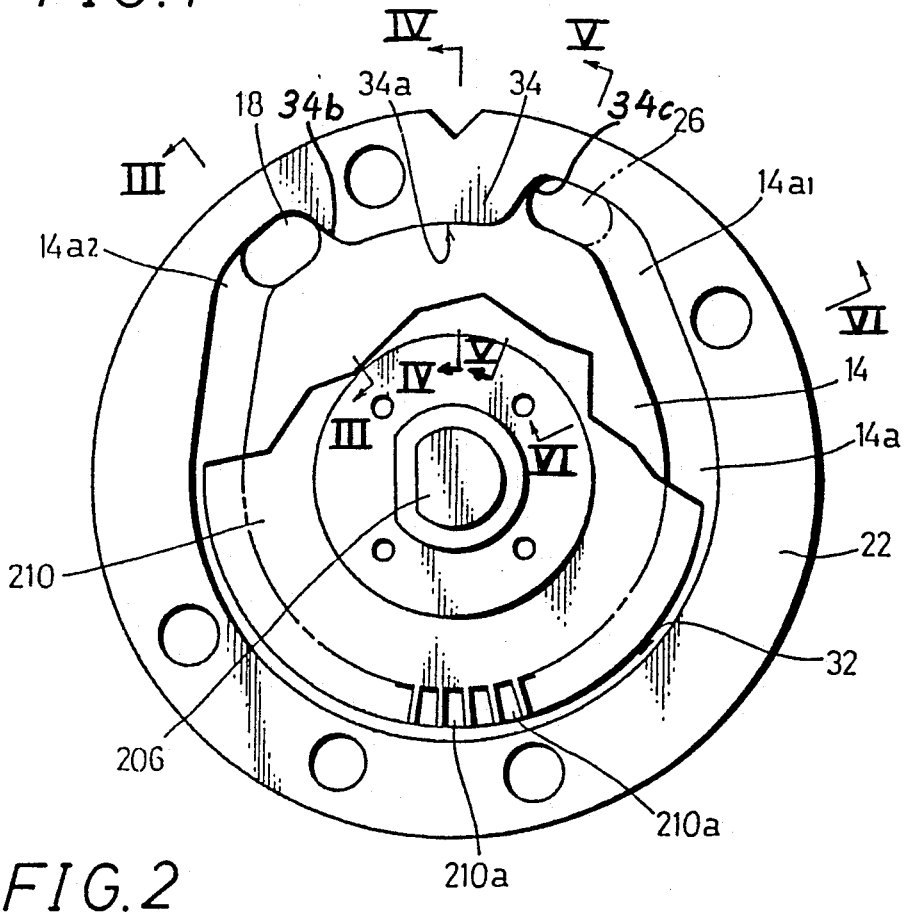

FIG. 1 shows a horizontal cross sectional view at a first or lower impeller 208 and FIG. 2 shows a similar view at a second or upper impeller 210.

Figure 15:
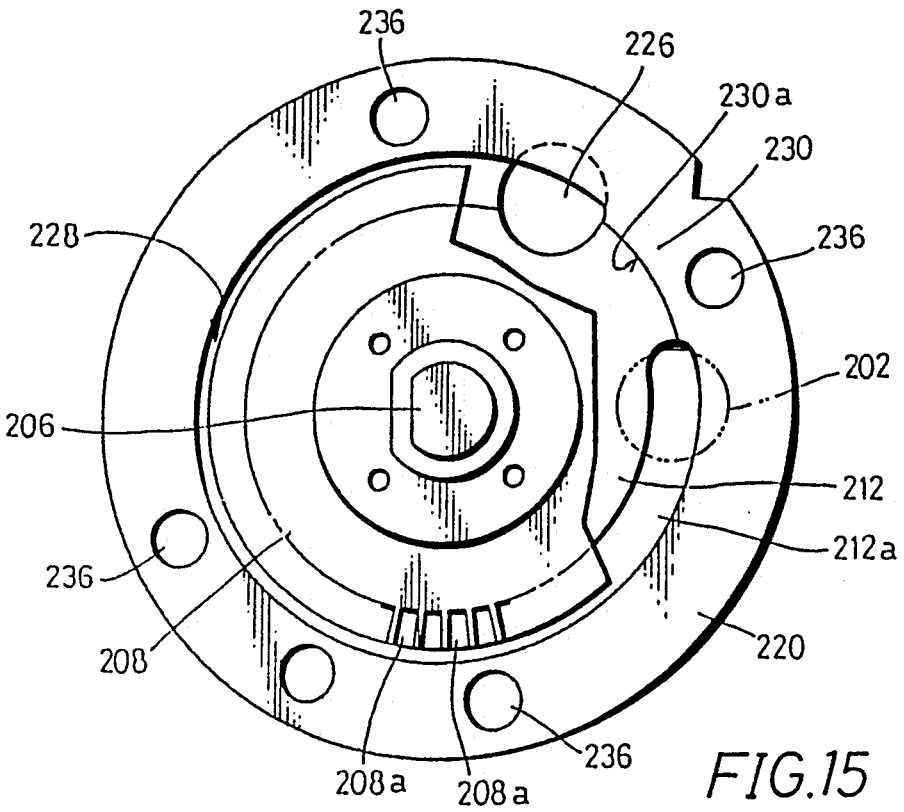
FIG.15 Prior Art
FIGS. 15 and 16 show conventional examples, which are views corresponding to the ones taken along the lines XV—XV and XVI—XVI in FIG. 12.

In FIG. 1 (corresponding to FIG. 15 showing a conventional example), a groove 12*a* of an intermediate plate 12 at the side of the first impeller 208 has a downstream groove portion 12*a*1 which extends along the substantially tangent direction of the impeller 208 from a position of about 45 degrees from the center of a communication hole 26 in the reverse direction of the flow of the fluid reaching the outside of the first impeller 208 and a surrounding ring like wall of a spacer 20 with the same width. The downstream groove portion 12*a*1 smoothly curves at a point close to the end portion in the shape of a circular arc being substantially concentric with the impeller 208. A communication hole 26 is formed in the shape of a elongated hole with the same width as the downstream groove portion 12*a*1. The elongated axis of the communication hole 26 is concentric with the impeller 208 and spacer 20, and it is located outside of the impeller 208. An inner circumferential surface of the first spacer 20 is formed in the shape of a curved surface along the groove 12*a*. That is, the inner circumferential surface of the first spacer 20 is recessed at a portion corresponding to the downstream groove portion 12*a*1 and the communication hole 26. Both end portions trailing end 30*b* and leading end 30*c* of an arcuate surface 30*a* of a partition wall 30 are formed round and smooth.

Figure 16:
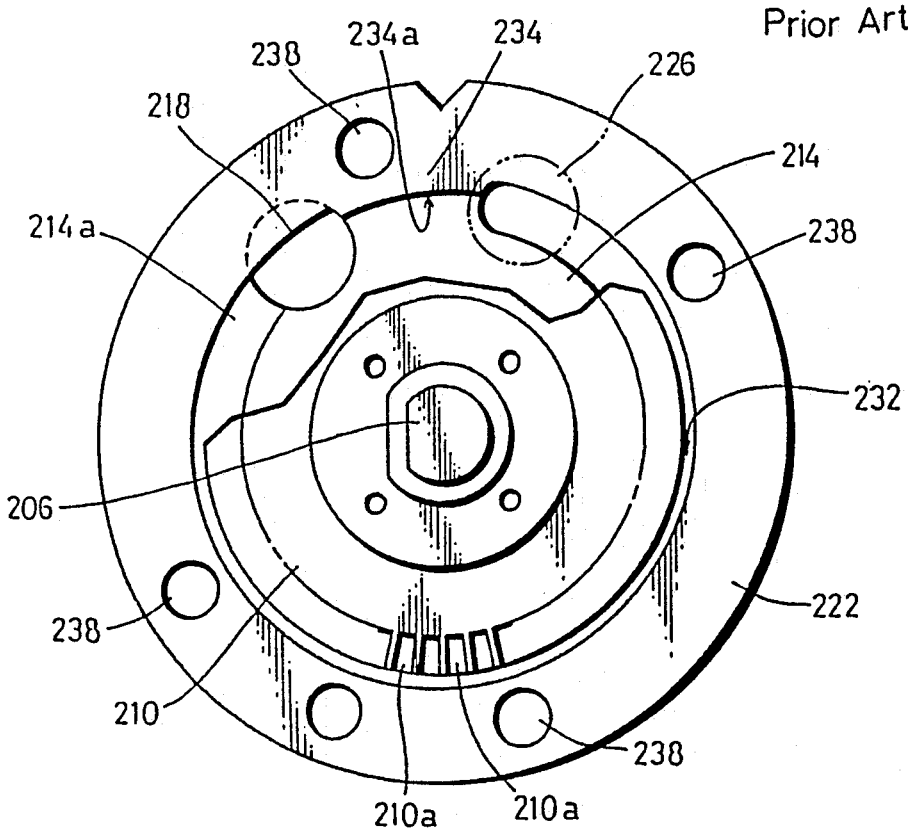
FIG.16 Prior Art

Next, in FIG. 2 (corresponding to FIG. 16 showing a conventional example), a groove 14*a* of a cover 14 has an upstream groove portion 14*a*1 starting from the position corresponding to the communication hole 26, and has a downstream groove portion 14*a*2 extending along the substantially tangent direction of a second impeller 210 from a position of about 45 degrees from the center of an outlet hole 18 in the reverse direction of the flow direction of the fluid reaching the outside of the second impeller 210 and a surrounding ring-like wall of a spacer 22 with the same width. The downstream groove portion 14*a*2 smoothly curves at a point close to the end portion in the shape of a circular arc being concentric with the impeller 210. The outlet hole 18 is formed in the shape of a elongated hole with the same width as the downstream groove portion 14*a*2. The elongated axis of the outlet hole 18 is concentric with the impeller 210 and spacer 22, and it is located outside of the impeller 210. An inner circumferential surface of the second spacer 22 is formed in the shape of a curved surface along the groove 14*a*. That is, the inner circumferential surface of the spacer 22 is recessed at portions corresponding to the upstream groove portion 14*a*1, the downstream groove portion 14*a*2, the communication hole 26 and the outlet hole 18. Both end portions trailing end 34*b* and leading 34*c* of an arcuate surface 34*a* of a partition wall 34 are formed round and smooth.

Figure 3:
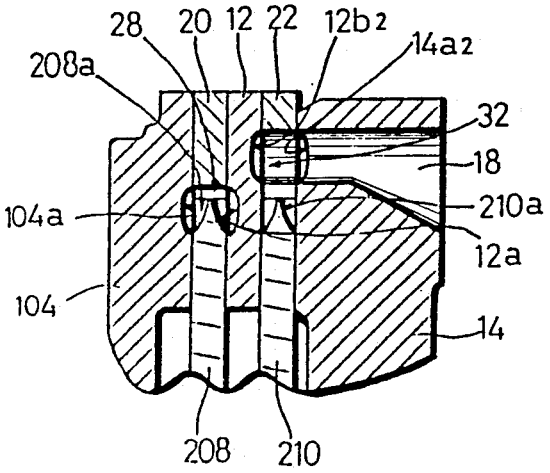
FIGS. 3 to 6 are sectional views taken along the lines III—III, IV—IV, V—V, VI—VI in FIGS. 1 and 2, respectively.

Although detailed illustration is omitted, a groove 104*a* of a body 104 shown in FIG. 3 is formed in symmetry with the groove 12*a* of the intermediate plate 12, forming therebetween a flow passage 28 starting from an inlet hole 2 and reaching to the communication hole 26. A groove 12*b* shown in FIG. 6 at the side of a second impeller 210 of the intermediate plate 12 is also formed in symmetry with the groove 14*a* of the cover 14, forming therebetween a flow passage 32 starting from the communication hole 26 and reaching the outlet hole 18.

Figure 4:
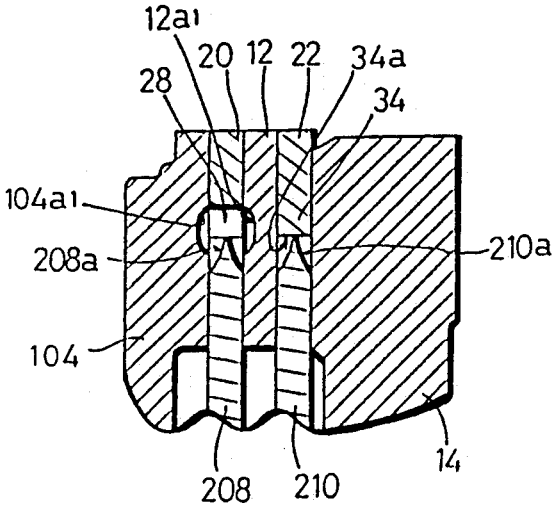
Figure 5:
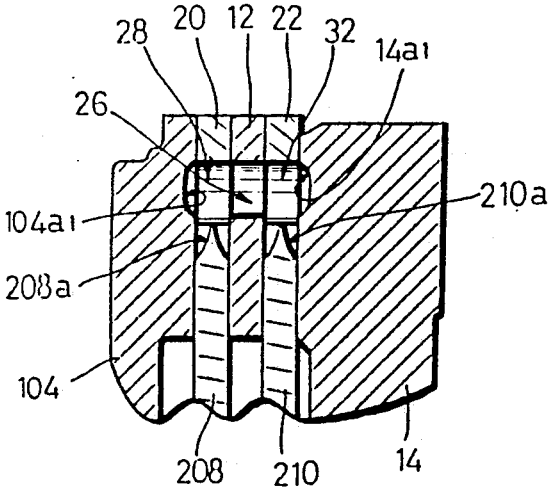
Figure 6:
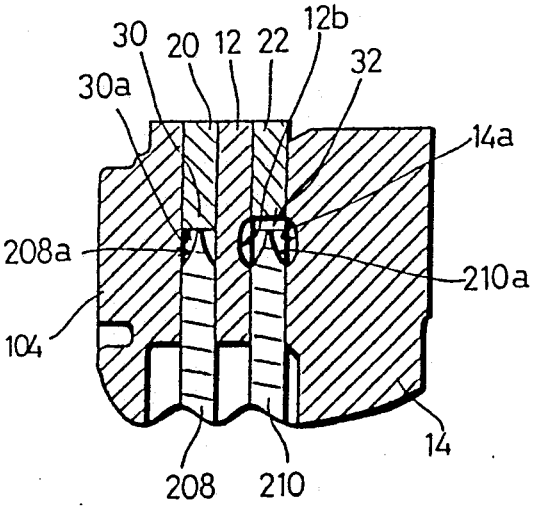

Next, the flow passages 28 and 32 of each pump chamber constructed as described above will be described with reference to FIGS. 3 to 6. The flow passage 28 is formed around the periphery of the first impeller 208 as shown in FIG. 3 and, except at a downstream groove 12a1, as shown in FIG. 4, the passage 28 at the downstream groove 12a1 goes away from the periphery of the first impeller 208, and gradually widens the sectional area of the flow passage 28 and at the position of the communication hole 26, as shown in FIG. 5, the downstream grooves 12a1 and 14a1 are separated from the impeller and the sectional area of the passage 28 becomes the maximum. At the position of the partition wall 30 as shown in FIG. 6, the sectional area of the flow passage 28 becomes almost zero.

On the other hand, the area of the flow passage 32 is the maximum, at the proximal end portion or the communication hole 26, as shown in FIG. 5, and as going toward the downstream side, the passage 32 close to the periphery of the second impeller 210 and gradually narrows the area of the flow passage 32. At the further downstream side, as going toward the terminal end or the outlet hole 1B, the flow passage 32 goes away from the proximal end portion of the second impeller 210, gradually broaden the area of the glow passage, and at the position of the terminal end or the outlet hole 18, as shown in FIG. 3, the passage 32 is completely separated from the second impeller 210, and the sectional area of the passage becomes maximum. At the position of the partition wall 34, as shown in FIG. 4, the area of the flow passage becomes almost zero.

Next, the operation of the above-mentioned embodiment will be described. The fuel conducted from the outlet hole 22 to the flow passage 28 of the first-stage pump chamber proceeds to the downstream grooves 12a1 and 14a1 in the vortex flow by the effect of the vane channel 208a of the first impeller 208 but as coming close to the communication hole 26, the area of the flow passage 28 gradually widens. Therefore, the velocity of the flow of the fuel weakens as a whole by the diffusing effect. Moreover the flow passage 28 gradually goes away from the periphery of the first impeller 208. Accordingly, the vortex caused by the vane channel 208a weakens as the fluid flows along the grooves 12a1 and 14a1. As a result, after the velocity of the fuel as a whole weakens, and the vortex also weakens, the fluid collides with the partition wall 30. Therefore, the collision force is small and the noise is drastically reduced. The fluid is subsequently conducted to the flow passage 32 of the next-stage pump chamber from the communication hole 26. The communication hole 26 is positioned close to the circumferential portion of the second impeller 210. Therefore, the fluid smoothly flows into the flow passage 32 and is conducted to the outlet hole 18 after being affected by such noise reduction effect in that pump chamber.

A second preferred embodiment of the present invention will now be described with reference to FIGS. 7 and 8.

This embodiment is a modification of the first preferred embodiment as described above. Therefore, the same members are designated by the same reference numerals, the explanation being omitted.

Figure 7:
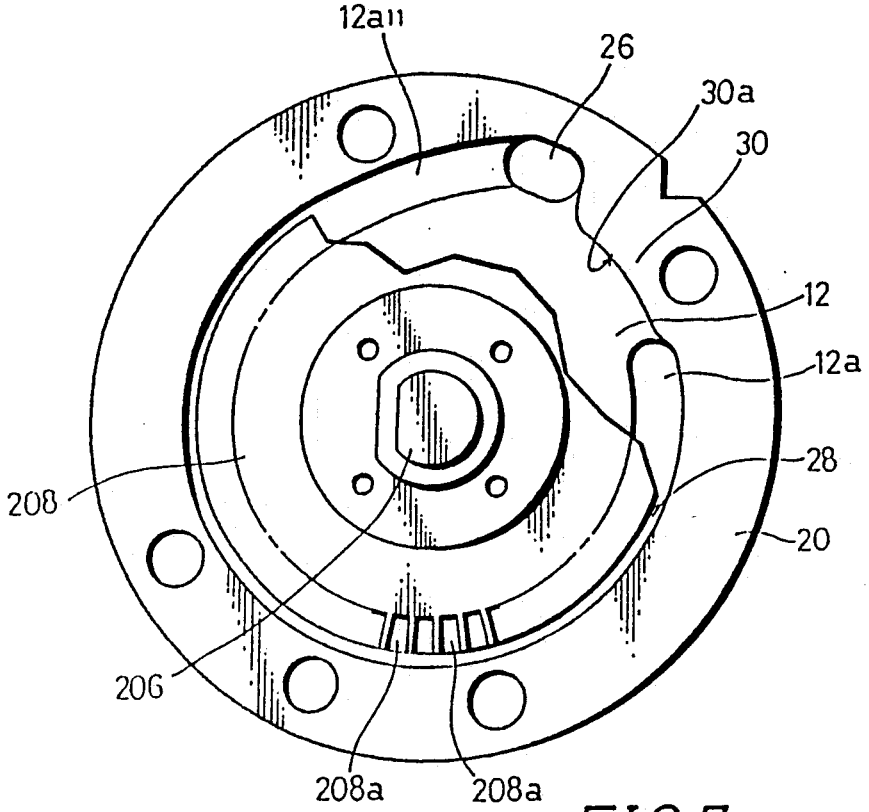
FIGS. 7 and 8 show a second preferred embodiment of the present invention which are sectional views corresponding to FIGS. 1 and 2, respectively.
Figure 8:
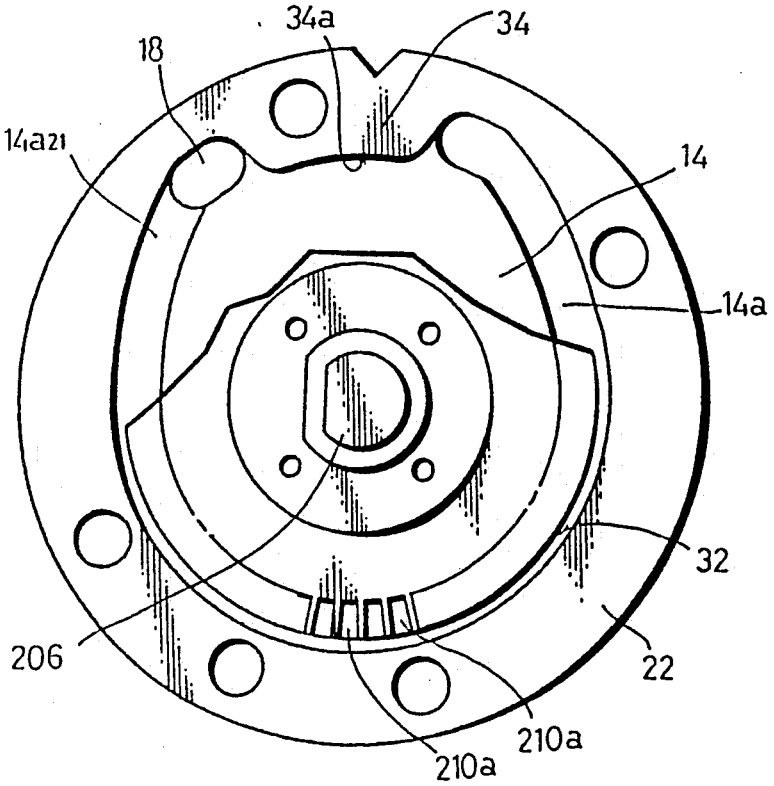
Figure 12:
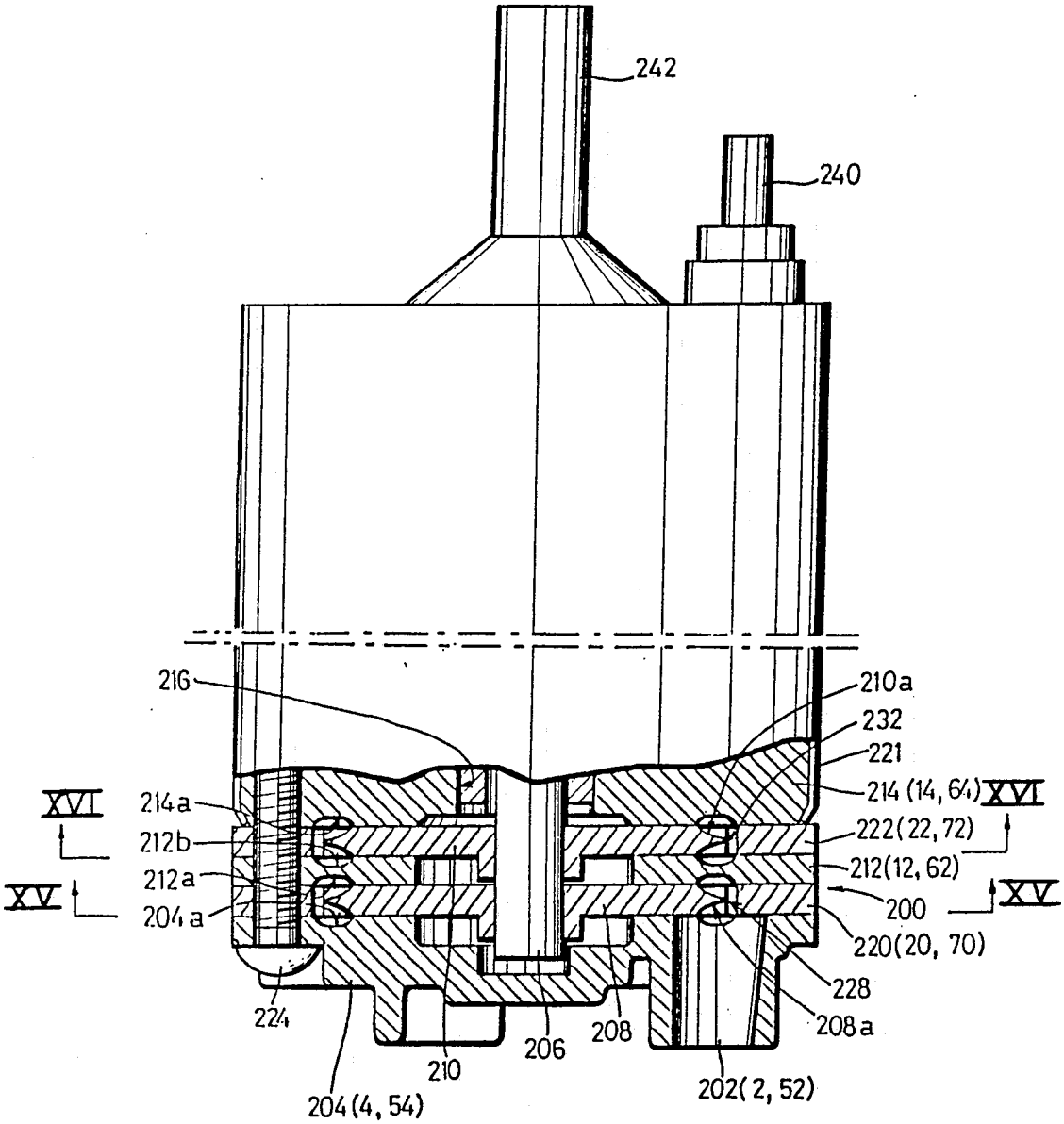
FIG.12 Prior Art
FIG. 12 is a vertical sectional view common to a conventional motor-driven fuel pump and a part of the preferred embodiment of the present invention.
Figure 13:
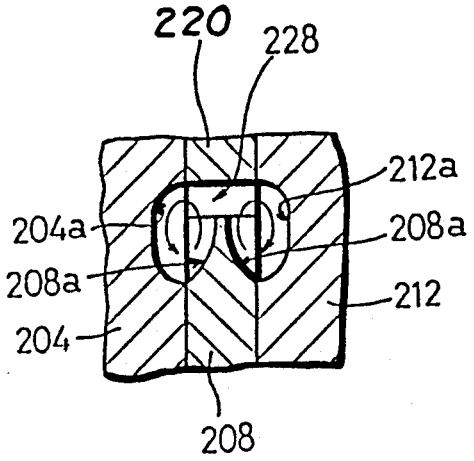
FIG.13 Prior Art
FIG. 13 is a partially enlarged view showing a groove at a first impeller side.
Figure 14:
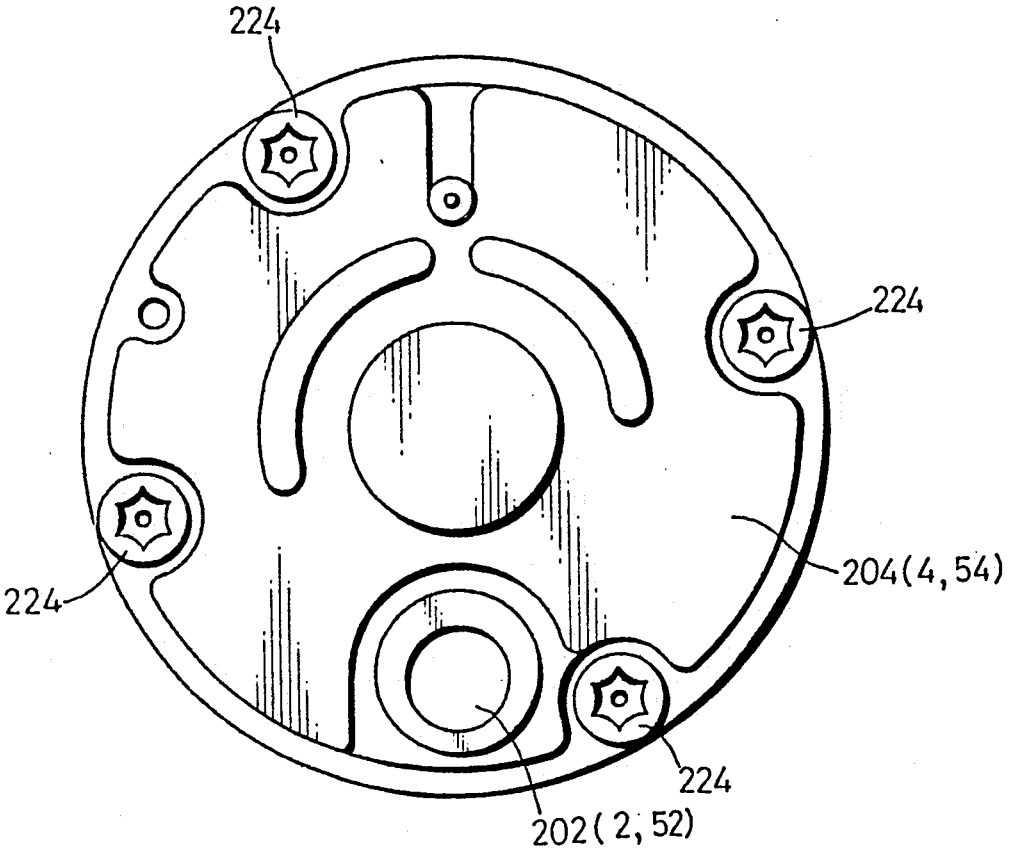
FIG.14 Prior Art
FIG. 14 is a bottom plan view of FIG. 12.

In the second preferred embodiment as shown in FIG. 7 (corresponding to FIG. 15 showing a conventional example), a downstream groove portion 12a11 of a groove 12a of an intermediate plate 12 at the side of the first impeller 208 is formed in the shape of a smooth curved line, which has no straight portion leading to the communication hole 26 positioned close to the circumferential portion of the first impeller 208 and outside thereof. As shown in FIG. 8 (corresponding to FIG. 16 showing a conventional example), an upstream groove portion 14a11 and downstream groove portion 14a21 of a groove 14a of the cover 14 are formed also in the shape of a smooth curved line which has no straight portion.

Accordingly, the operation of the present embodiment is substantially the same as the first embodiment described above, but the fuel flow in the flow passages 28 and 32 is more fluent especially at the terminal end portion, enabling the noise prevention effect to be enhanced.

A third preferred embodiment of the present invention will be described with reference to FIGS. 9 to 11.

This embodiment is a modification of the second preferred embodiment, the same members being designated by the same reference numerals and the explanation being omitted.

In the third preferred embodiment, as shown in FIG. 9 (corresponding to FIG. 15 showing a conventional example) and FIG. 11, the communication hole 26a formed on the intermediate plate 12 has on its inside an inclined surface 26a1 smoothly connecting with the bottom portion of a vane channel 210 of the second impeller 210. On the other hand, at the position corresponding to a communication hole 26a of a second spacer 22, an inclined surface 22a substantially parallel to the above inclined surface 26a1 is formed, being connected with an upstream groove portion 14a12 of a groove 14a of the cover 14. The upstream groove portion 14a12 is different from an upstream portion 14a1 shown in FIG. 10 (corresponding to FIG. 16 showing a conventional example), being formed on the same circumference as the groove portion connecting thereto.

Accordingly, in the present embodiment, the flow passage 32 is affected by the pressure raising function due to the vane channel 210a of the second impeller 210 from the starting end. Therefore, the length of the effective raising pressure flow passage becomes long, enabling the improvement in the pump capacity or the increase in the discharge amount.

Although the first to third embodiments described above relate to the two-stage pump mechanism provided with the first impeller 208 and the second impeller 210, namely, provided with two-stage pump chamber, the similar structure as this is applicable to any pump mechanism provided with one, three or more stage pump chamber.

Having thus described the preferred embodiment of the invention, it should be understood that numerous structural modifications and adaptations may be made without departing from the spirit of the invention.

What is claimed is:

1. In a cascade pump mechanism including a plurality of impellers each having outer circumferential vane channels, a wall member having a wall portion surrounding each impeller from its axial and radial directions and defining a plurality of pump chambers in series, inlet and outlet holes formed through said wall member, a communication hole formed through each wall portion in the axial direction of said wall member, so as to communicate said pump chambers with each other, and circumferential grooves formed on the wall member in the axial direction to form a series of flow passages leading from said inlet hole to said outlet hole through said communication hole; the improvement wherein said flow passage in each pump chamber is provided at the side close to said communication hole to the next-stage pump chamber or close to said outlet hole with a passage portion so designed as to have a radial size such that a portion overlapping said vane channels is gradually narrowed; and said passage portion is so formed as to go gradually outward in the radial direction, so as to gradually increase a flow area toward the downstream side.

2. The cascade pump mechanism as defined in claim 1, wherein said outlet hole or said communication hole formed on said wall member in the axial direction between said pump chambers is arranged to communicate a terminal portion of said passage portion.

3. The cascade pump mechanism as defined in claim 2, wherein said outlet hole or said communication hole is placed close to the circumferential portion of said impeller.

4. The cascade pump mechanism as defined in claim 3, wherein said outlet hole or said communication hole is formed in the shape of a slit in the circumferential direction.

5. The cascade pump mechanism as defined in claim 1, wherein said passage portion extends tangentially upstream.

6. In a regerative pump including:

a body forming a lower wall surface of a pump chamber;

a case forming an upper wall surface of said pump chamber;

a ring-like spacer interposed between said body and said case and forming a radially outside peripheral wall surface of said pump chamber;

an impeller provided in said pump chamber defined among said body, said case and said spacer so as to be rotted in one direction, said impeller having outer peripheral vane channels;

said ring-like spacer comprising a ring portion having a circular outer circumferential surface and forming said radially outside peripheral wall surface of said pump chamber, and a partition wall projecting inwardly from a part of an inner peripheral surface of said ring portion and extending in a predetermined angular range along the rotational direction of said impeller so as to form a leading end on a side of the rotational direction of said impeller, a trailing end on a counter side of the rotational direction of said impeller, and an inner peripheral surface opposed to an outer periphery of said impeller with a very small clearance defined between;

a fluid inlet hole formed through said body so as to be communicated with said pump chamber at a position corresponding to said leading end of said partition wall and said vane channels of said impeller;

a fluid outlet hole formed through said case so as to be communicated with said pump chambers at a position corresponding to said trailing end of said partition wall; and a pair of grooves formed on an upper surface of said body and a lower surface of said case and extending from said fluid inlet hole to said fluid outlet hole along the inner peripheral surface of said ring portion except the inner peripheral surface of said partition wall;

the improvement wherein;

a portion of said inner peripheral surface of said ring portion in the vicinity of said trailing end of said partition wall is formed with a recess gradually deepened radially outwardly within a predetermined angular range until said trailing end;

said grooves are gradually diverged radially outwardly at a downstream portion thereof along a bottom of said recess; and said fluid outlet hole is formed at a position corresponding to a downstream end of said grooves.

7. The regenerative pump as defined in claim 6, wherein said trailing end of said partition wall is rounded.

8. The regenerative pump as defined in claim 7, wherein said downstream portion of said grooves extends straight in tangential relationship to the outer periphery of said impeller.

9. The regenerative pump as defined in claim 8, wherein said fluid outlet hole comprises an elongated hole extending along the outer periphery of said impeller.

10. The regenerative pump as defined in claim 7, wherein said downstream portion of said grooves extends along a gentle curved line.

11. In a multi-stage regenerative pump including:

a body forming a lower surface of a first pump chamber;

a first ring-like spacer fixed on an upper surface of said body and forming a radially outside peripheral wall surface of said first pump chamber;

an intermediate plate fixed on an upper surface of said first spacer and forming an upper wall surface of said first pump chamber and a lower wall surface of a second pump chamber;

a first impeller provided in said first pump chamber defined among said body, said intermediate plate and said first spacer so as to be rotated in one direction, said first impeller having outer peripheral vane channels;

a second ring-like spacer fixed on an upper surface of said intermediate plate and forming a radially outside peripheral wall surface of said second pump chamber;

a case forming an upper wall surface of said second pump chamber;

a second impeller provided in said second pump chamber defined among said intermediate plate, said case and said second spacer so as to be rotated in said one direction, said second impeller having outer peripheral vane channels;

each of said first and second spacers comprising a ring portion having a circular outer circumferential surface and forming said radially outside peripheral wall surface of each of said first and second pump chambers, and a partition wall projecting inwardly from a part of an inner peripheral surface of said ring portion and extending in a predetermined angular range along the rotational direction of each of said first and second impellers as so to form a leading end on a side of the rotational direction of each said impeller, a trailing end on a counter side of the rotational direction of each said impeller, and an inner peripheral surface opposed to an outer periphery of each said impeller with a very small clearance defined therebetween;

a fluid inlet hole formed through said body so as to be communicated with said first pump chamber at a position corresponding to said leading end of said partition wall of said first spacer and said vane channels of said first impeller;

a communication hole formed through said intermediate plate to communicate said first pump chamber with said second pump chamber at a position corresponding to said trailing end of said partition wall of said first spacer and said leading end of said partition wall of said second spacer;

a fluid outlet hole formed through said case so as to be communicated with said second pump chamber at a position corresponding to said trailing end of said partition wall of said second spacer;

a first pair of grooves formed on an upper surface of said body and a lower surface of said intermediate plate and extending from said fluid inlet hole to said communication hole along the inner peripheral surface of said ring portion of said first spacer except the inner peripheral surface of said partition wall of said first spacer; and a second pair of grooves formed on an upper surface of said intermediate plate and a lower surface of said case and extending from said communication hole to said fluid inlet hole along the inner peripheral surface of said ring portion of said second spacer except the inner peripheral surface of said partition wall of said second spacer;

the improvement wherein:

a portion of said inner peripheral surface of said ring portion of each of said first and second spacers in the vicinity of said trailing end of said partition wall of each said spacer is formed with a recess gradually deepened radially outwardly within a predetermined angular range until said trailing end of said partition wall of each said spacer;

said grooves are gradually diverged radially outwardly at a downstream portion thereof along a bottom of said recess;

a lower opening of said communication hole is formed at a position corresponding to a downstream end of said first pair of said grooves; and said fluid outlet hole is formed at a position corresponding to a downstream end of said second pair of said grooves.

12. The multi-stage regenerative pump as defined in claim 11, wherein said lower opening of said communication hole faces the downstream end of said first pair of said grooves outside the outer periphery of said first impeller, and an upper opening of said communication hole faces said vane channels of said second impeller.

13. The multi-stage regenerative pump as defined in claim 11, wherein said trailing end of said partition wall of each of said first and second spacers is rounded.

14. The multi-stage regenerative pump as defined in claim 13, wherein said downstream portion of each of said first and second pairs of said grooves extends straight in tangential relationship to the outer periphery of each of said first and second impellers, respectively.

15. The multi-stage regenerative pump as defined in claim 14, wherein said fluid outlet hole comprises an elongated hole extending along the outer periphery of said second impeller.

16. The multi-stage regenerative pump as defined in claim 13, wherein said downstream portion of each of said first and second pairs of said grooves extends along a gentle curved line.

* * * * *